US007971565B2

(12) United States Patent
Catton et al.

(10) Patent No.: US 7,971,565 B2
(45) Date of Patent: Jul. 5, 2011

(54) INTAKE MANIFOLD AND ASSOCIATED PRODUCTION METHOD

(75) Inventors: Piers Catton, Gosport (GB); Andrew Wade, Salisbury Wiltshire (GB)

(73) Assignee: Mahle Filtersysteme GmbH, Stuttgart (DE)

( * ) Notice: Subject to any disclaimer, the term of this patent is extended or adjusted under 35 U.S.C. 154(b) by 1316 days.

(21) Appl. No.: 10/540,174

(22) PCT Filed: Dec. 11, 2003

(86) PCT No.: PCT/DE03/04087

§ 371 (c)(1),
(2), (4) Date: May 2, 2006

(87) PCT Pub. No.: WO2004/055355

PCT Pub. Date: Jul. 1, 2004

(65) Prior Publication Data

US 2010/0192891 A1 Aug. 5, 2010

(30) Foreign Application Priority Data

Dec. 18, 2002 (DE) ..... 102 59 100

(51) Int. Cl.
*F02M 35/10* (2006.01)

(52) U.S. Cl. ..... 123/184.61; 123/184.21

(58) Field of Classification Search ..... 123/184.21, 123/184.61

See application file for complete search history.

(56) References Cited

U.S. PATENT DOCUMENTS

| | | | | |
|---|---|---|---|---|
| 3,920,268 | A * | 11/1975 | Stewing | 285/21.1 |
| 3,920,787 | A * | 11/1975 | McDowell et al. | 285/21.1 |
| 4,261,947 | A * | 4/1981 | Ogi | 264/263 |
| 5,992,369 | A | 11/1999 | Mehne | |
| 6,021,753 | A | 2/2000 | Chaffin et al. | |
| 6,117,380 | A | 9/2000 | Shirai et al. | |
| 6,267,093 | B1 | 7/2001 | Lohr | |
| 6,321,708 | B1 | 11/2001 | Wehner et al. | |
| 6,363,900 | B1 | 4/2002 | Homi et al. | |
| 2002/0148427 | A1 * | 10/2002 | Jones et al. | 123/184.61 |

FOREIGN PATENT DOCUMENTS

| | | |
|---|---|---|
| DE | 697 16 082 | 6/2003 |
| EP | 0 913 241 | 5/1999 |
| EP | 0 984 155 | 3/2000 |
| FR | 2 690 376 | 10/1993 |
| JP | 2000145552 A * | 5/2000 |

* cited by examiner

*Primary Examiner* — Noah Kamen
(74) *Attorney, Agent, or Firm* — Collard & Roe, P.C.

(57) ABSTRACT

The invention relates to an intake manifold (1) for a primary air system of an internal combustion engine, especially in a motor vehicle. The inventive intake manifold (1) comprises a pipe section (2) that is composed of at least two pipe parts (3, 4) which are produced as injection-molded parts and are joined to each other by means of a connection (12). Said connection (12) is formed by a material that is sprayed on or injected in the area of a dividing line (5) between the pipe parts (3, 4).

15 Claims, 2 Drawing Sheets

INTAKE MANIFOLD AND ASSOCIATED PRODUCTION METHOD

CROSS REFERENCE TO RELATED APPLICATIONS

Applicants claims priority under 35 U.S.C. §119 of German Application No. DE 102 59 100.8 filed on Dec. 18, 2002. Applicants also claim priority under 35 U.S.C. §365 of PCT/DE2003/004087 filed on Dec. 11, 2003. The international application under PCT article 21(2) was not published in English.

BACKGROUND OF THE INVENTION

Field of the Invention

The present invention relates to an intake manifold for a fresh air system of an internal combustion engine, in particular in a motor vehicle. This invention also relates to a method for manufacturing such an intake manifold.

An internal combustion engine, in particular in a motor vehicle, is supplied with fresh air via a fresh air system. An intake manifold of the type mentioned above forms a part of the fresh air guidance within such a fresh air system. For example, the intake manifold guides the fresh air from an air filter to a fresh air collector from which the fresh air is distributed to individual cylinders or the internal combustion engine.

The present invention is related to the problem of providing an improved embodiment for an intake manifold and/or a respective manufacturing process which will lead to low manufacturing costs in particular.

SUMMARY OF THE INVENTION

This problem is solved according to this invention by the objects of the independent claims. Advantageous embodiments are the object of the dependent claims.

The present invention is based on the general idea of assembling a pipe section of the intake manifold from multiple injection-molded pipe parts, in particular made of plastic, and are joined to one another in the area of their parting line with an integrally injected material. In contrast with blow-molded parts, injection-molded parts can be manufactured easily with uniform wall thicknesses. To manufacture the inventive intake manifold, a two-step manufacturing process is thus necessary in which in a first step the pipe parts are produced by injection molding and in a second step the assembled pipe parts are joined together by injection molding or integral molding of the joint formed by the material. This process can be automated especially easily. In addition, the selected design offers the possibility of molding at least one additional component onto the pipe section during the second step of the manufacturing process.

Plastics, elastomers, resins and rubber are especially suitable materials for producing the joint by injection molding or integral molding.

According to a refinement of this invention, a bellows section may be integrally molded on one end of the pipe section and/or a ring gasket may be integrally molded on another end of the pipe section.

Then the bellows sections and/or the ring gasket is expediently integrally molded in the same process step and/or in the same operation as the integral molding or injection molding of the joint. Therefore, it is possible to eliminate an additional operation.

The multipart design proposed according to this invention makes it possible to select a suitable material in accordance with the requirements of the respective component of the intake manifold. For example, the bellows section can therefore be designed to be much more flexible than the pipe section. Accordingly, a material that is specially suitable for sealing may be used for the ring gasket.

It is especially advantageous to use the same material for the joint and for the bellows sections and/or for the ring gasket so that the second manufacturing step can be simplified greatly.

In another advantageous embodiment, the assembled pipe parts may form at least one injection channel into which the compound can be injected in the area of its parting line. Due to this design, the injection mold for shaping the joint can be integrated into the pipe parts, thereby simplifying the shaping of the injection mold accordingly. Additional important features and advantages of this invention are derived from the subclaims, the drawings and the respective description of the figures on the basis of the drawings.

It is self-evident that the features mentioned above and those to be discussed below can be used not only in the combination given but also in any other combinations or alone without going beyond the scope of the present invention.

BRIEF DESCRIPTION OF THE DRAWINGS

A preferred exemplary embodiment of this invention is depicted in the drawings and explained in greater detail in the following description where the same reference notation is used to refer to the same or functionally same or similar parts.

They show, schematically in each case

DETAILED DESCRIPTION OF THE PREFERRED EMBODIMENTS

Figures 1, 2, 4:
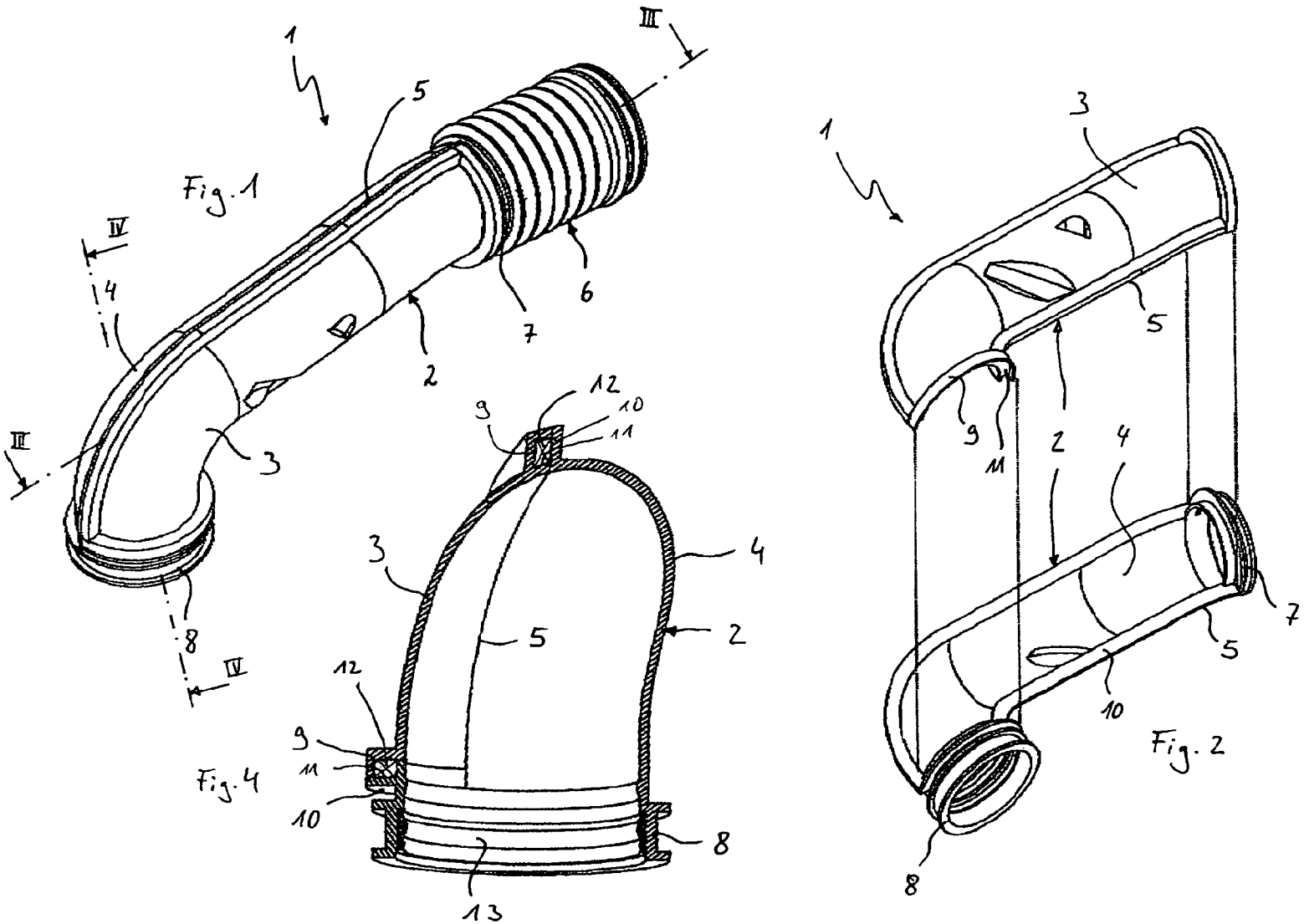
FIG. 1 a perspective view of an inventive intake manifold.
FIG. 2 an exploded diagram of a pipe section of the intake manifold.

According to FIG. 1, an inventive intake manifold 1 has a pipe section 2 assembled from multiple pipe parts 3 and 4 (two in this case). The two pipe parts 3, 4 are each manufactured as injection-molded parts, expediently made of plastic, and are adjacent to one another along a parting line 5 in the assembled state. In addition, the intake manifold 1 in the preferred embodiment illustrated here has a bellows section 6 which is also manufactured as an injection-molded part, preferably made of plastic. An integral design in which the bellows section 6 is integrally molded or vulcanized onto a first end 7 of the pipe section 2 is preferred.

With reference to FIG. 2, the pipe section 2 is divided into its pipe parts 3 and 4, so that the first pipe part 3 and the second pipe part 4 are each designed as half shells completing one another in a complementary fashion. It is of interest here that both the first pipe end 7 and a second pipe end 8 at a distance from the former are designed in one piece, i.e., integrally on the second pipe part 4. This design makes it possible for the pipe ends 7, 8 to each be designed as one-piece flanges in which there are no problematical parting lines.

Figure 3:
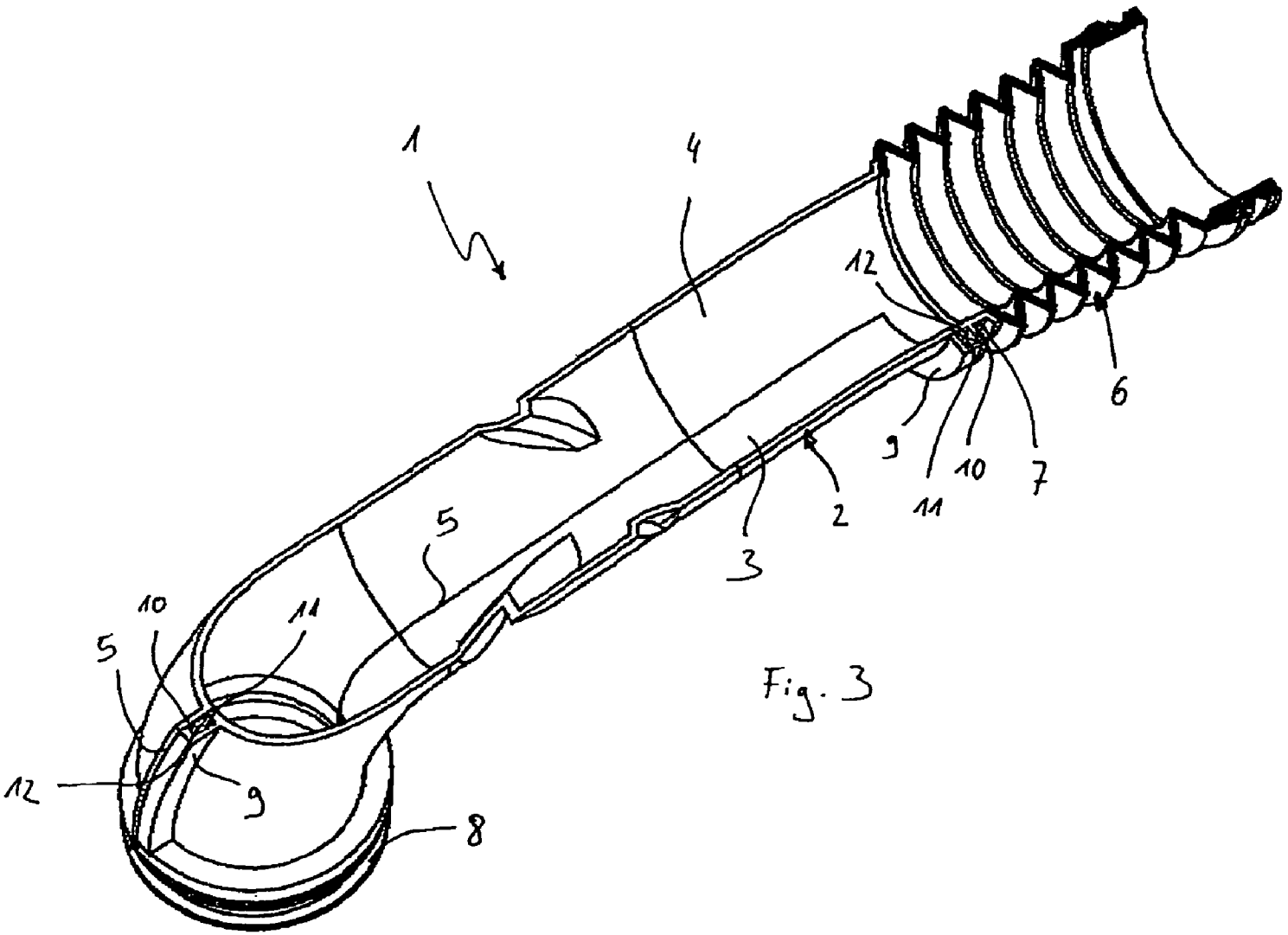
FIG. 3 a sectional view through the intake manifold according to the sectional lines III in FIG. 1 and FIG. 4 a sectional view through the intake manifold according to the sectional lines IV in FIG. 1.

In the area of the parting line 5, one of the pipe parts, here the first pipe part 3, has a U-profile 9, which is open toward the second pipe part 4 and extends along a completely closed circumference on an outer edge (not explained further here) of the first pipe part 3. Complementary to this, a collar 10 is formed on the second pipe part 4, likewise running in a completely closed circumference corresponding to the outside edge of the first pipe part 3. When the two pipe parts 3, 4 are properly assembled, the collar 10 closes the U profile 9 along the entire length of the U profile 9, forming a hollow space. This hollow space forms an injection channel 11 into which a suitable material for forming a joint 12 (see FIGS. 3, 4) can be injected at a suitable location. With the help of this joint 12, the two pipe parts 3, 4 can be joined together.

According to FIG. 4, a ring gasket 13 acting axially and made of plastic, for example, may be integrally molded or vulcanized onto the second pipe end 8, specifically on the inside here.

According to this invention, the intake manifold 1 can be manufactured as follows:

First, in a first step, i.e., in the first operation of the manufacturing process, the pipe parts 3, 4 are manufactured as separate injection-molded parts. Then, in a second step or operation, the pipe parts 3, 4 are assembled and joined together by integral molding and/or injection of material to form the joint 12.

Integral molding of the bellows section 6 and/or the sealing ring 13 may expediently also be performed in a second operation or process step so that the pipe parts 3, 4 are equipped with the joint 12, the bellows section 6 and/or the ring gasket 13 in the same mold. The intake manifold 1 may thus be manufactured especially economically.

The choice of the material used for the respective component is made essentially as a function of the requirements made of the particular component during operation of the intake manifold 1. For example, the bellows section 6 must be relatively flexible to be able to fulfill its function optimally in the installed state of the intake manifold 1. Preferably the intake manifold 1 is installed into a fresh air system (not shown here) of an internal combustion engine, in particular a motor vehicle. During operation of the internal combustion engine, relative movements may occur between the two sections of the fresh air system, connected by the intake manifold 1. To be able to compensate for these relative movements, the intake manifold 1 is equipped with bellows section 6.

In contrast with that, the material for the ring gasket 13 is selected so as to achieve the desired sealing effect.

For the joint 12, the material is selected so as to establish a sufficiently secure and airtight coupling between the two pipe parts 3, 4.

The joint 12 may be based on adhesion, for example. The material injected or integrally molded to form the joint 12 is then selected as a function of the material used for the pipe parts 3, 4 so that an adhesive bond is formed with the wetted wall sections in the injection-molding channel 11 until the integrally molded material hardens.

To improve the adhesion effect, it may be expedient to enlarge the surface area wettable by the material of the joint 12 on the pipe parts 3, 4 within the injection channel 11. For example, a protruding web could be designed in one piece on the collar 10, with the web protruding into the U profile 9 when the parts are assembled. Likewise, multiple webs on the collar 10 and in the U profile 9 are also possible.

However, the material of the joint 12 may also be selected so that a coupling based on fusion develops between the material of the joint 12 and the material of the pipe parts 3, 4 in integral molding and/or injection of the joint 12. In the case of such a fusion joint, the material of the pipe parts 3, 4 would be melted at the surface, thus forming a diffusion zone in which the materials form a bonded joint. In this procedure, a material-to-material bond is formed between the two pipe parts 3, 4 via the joint 12, more or less corresponding to a welded joint.

To improve the fusion effect, it is possible to provide at least one melting web in the U profile 9 and/or on the collar 10, said melting web being shaped in such a way that it melts or begins to melt especially easily because of the prevailing temperatures in integral molding of the joint 12. This supports the diffusion effect, i.e., the fusion of the materials.

In addition, it is possible with the help of the joint 12 to create a form-fitting joint between the pipe parts 3, 4 by shaping the contours sheathed by the material of the joint 12 in a suitable way in the area of the parting line 5. For example, undercuts may be formed, also permitting a mutual engagement. In the case of such a joining principle based on a form-fitting joint, there need not be any adhesion or fusion between the materials of the joint 12 and the pipe parts 3, 4. However it is clear that the aforementioned joining principles may also be used as a mixed form to achieve especially intensive bonding between the pipe parts 3, 4.

The joining principles described above for the joint 12 can essentially also be implemented with the integrally molded bellows section 6 and with the integrally molded ring gasket. In other words, the joint between the pipe section 2 and the bellows section 6 on the one hand and/or between the pipe section 2 and the ring gasket 13 on the other hand can also be based on adhesion and/or fusion and/or a form-fitting joint.

Suitable materials for forming the pipe parts 3, 4 on the bellows section 6, the ring gasket 13 and the joint 12 may include plastics, adhesives, elastomers, resins and rubber.

To simplify the manufacturing process, in particular the second manufacturing step, i.e., operation, it is expedient to use the same material for injection molding of the joint 12 and the bellows section 6 and/or for the ring gasket 13. This material may differ from the material used to manufacture the pipe parts 3, 4.

In addition, it may be advantageous to design an injection mold (not shown here) which is used for integral molding of the joint 12 and the bellows section 6 and/or the ring gasket 13 so that a hollow space is used to form the joint 12, i.e., the injection channel 11 here, communicates with another hollow space that serves to form the bellows section 6 and/or communicates with another hollow space which serves to form the ring gasket 13. For at least two of the total of three integrally molded components (joint 12, bellows section 6, ring gasket 13), the same injection molding ports and vent ports may thus be used, thereby simplifying the implementation of the second operation and making it more economical. If the hollow spaces for forming the joint 12 and the bellows section 6 communicate with one another, the joint 12 and the bellows section 6 form an integral one-piece unit in the finished intake manifold 1. The same thing is also true of the joint 12 and the ring gasket 13 if the hollow spaces for forming these components also communicate with one another.

The invention claimed is:

1. An intake manifold for a fresh air system of an internal combustion engine, in a motor vehicle, the intake manifold having a pipe section assembled from at least two pipe parts; wherein the at least two pipe parts are manufactured as injection-molded parts and are joined together by a joint formed by a material, the material being integrally molded or injected into an area of a parting line between the at least two pipe parts;

wherein the intake manifold has a bellows section joined to the pipe section;

wherein the bellows section is designed as an injection-mold part and is integrally molded or vulcanized onto the pipe section; and wherein the joint and the bellows section are made of the same material.

2. The intake manifold according to claim 1, wherein the at least two pipe parts form in the area of the parting line at least one injection channel, and wherein the joint is injected into the at least one injection channel.

3. The intake manifold according to claim 1, wherein the material of the joint is coordinated with the material of the at least two pipe parts so that the material of the joint attaches the at least two pipe parts to one another via adhesion and/or fusion.

4. The intake manifold according to claim 1, wherein the at least two pipe parts are designed in the area of the parting line so that the material of the joint joins the at least two pipe parts together in a form-fitting manner.

5. A method for manufacturing an intake manifold for a fresh air system of an internal combustion engine in a motor vehicle in which at least two pipe parts are manufactured as injection-molded parts, in which the at least two pipe parts are joined together to form a pipe section, and in which a joint is integrally molded or injected using a material which joins the at least two pipe parts to one another in an area of a parting line between the at least two pipe parts, wherein a bellows section is integrally molded or vulcanized onto one end of the pipe section; and wherein the integral molding or injection of the joint and integral molding or vulcanization of the bellows section are performed in a joint operation.

6. The method according to claim 5, wherein before integral molding or injection of the compound and before integral molding or vulcanization of the bellows section, the at least two pipe parts are assembled to form a hollow space for receiving material of the bellows section with one hollow space or with multiple hollow spaces to accommodate material of the joint.

7. The method according to claim 5, wherein the at least two pipe parts in the assembled state form at least one injection channel into which the material of the joint is injected in the area of their parting line.

8. The method according to claim 5, wherein the material of the joint is coordinated with the material of the at least two pipe parts so that the material of the joint joins the at least two pipe parts to one another via adhesion and/or fusion.

9. The method according to claim 5, wherein the at least two pipe parts are designed in the area of their parting line so that the material of the joint joins the at least two pipe parts together in a form-fitting manner.

10. The method according to claim 5, wherein the same material is used for at least two members selected from the group consisting of the joint, the bellows section and a ring gasket.

11. A method for manufacturing an intake manifold for a fresh air system of an internal combustion engine, in particular in a motor vehicle in which at least two pipe parts are manufactured as injection-molded parts, in which the at least two pipe parts are joined together to form a pipe section, in which a joint is integrally molded or injected using a material which joins the at least two pipe parts to one another in an area of a parting line between the at least two pipe parts, wherein a ring gasket is integrally molded or vulcanized onto an end of the pipe section.

12. The method according to claim 11, wherein the integral molding of the ring gasket is performed in the same operation as the integral molding of the bellows section and/or the integral molding or injection of the joint.

13. An intake manifold for a fresh air system of an internal combustion engine in a motor vehicle, the intake manifold having a pipe section assembled from at least two pipe parts;

wherein the at least two pipe parts are manufactured as injection-molded parts and are joined together by a joint formed by a material, the material being integrally molded or injected into an area of a parting line between the at least two pipe parts;

wherein the intake manifold has a bellows section joined to the pipe section;

wherein the bellows section is designed as an injection-mold part and is integrally molded or vulcanized onto the pipe section; and wherein the joint and the bellows section are designed in one piece together.

14. A method for manufacturing an intake manifold for a fresh air system of an internal combustion engine in a motor vehicle in which at least two pipe parts are manufactured as injection-molded parts, in which the at least two pipe parts are joined together to form a pipe section, and in which a joint is integrally molded or injected using a material which joins the at least two pipe parts to one another in an area of a parting line between the at least two pipe parts, wherein a bellows section is integrally molded or vulcanized onto one end of the pipe section; and wherein a first type of material is used for the joint and for the bellows section.

15. An intake manifold for a fresh air system of an internal combustion engine in a motor vehicle, the intake manifold having a pipe section assembled from at least two pipe parts, the at least two pipe parts being manufactured as injection-molded parts and being joined together by a joint formed by a material, the material being integrally molded or injected into an area of a parting line between the at least two pipe parts, wherein a ring gasket is integrally molded or vulcanized onto the pipe section.

* * * * *

UNITED STATES PATENT AND TRADEMARK OFFICE

CERTIFICATE OF CORRECTION

PATENT NO. : 7,971,565 B2
APPLICATION NO. : 10/540174
DATED : July 5, 2011
INVENTOR(S) : P. Catton et al.

It is certified that error appears in the above-identified patent and that said Letters Patent is hereby corrected as shown below:

In particular, in Column 6, lines 2-3 (Lines 2-3 in Claim 11) after the word "engine" please delete the following: ", in particular".

Signed and Sealed this
Sixteenth Day of August, 2011

David J. Kappos

David J. Kappos
*Director of the United States Patent and Trademark Office*